US007617570B2

(12) United States Patent
Hill

(10) Patent No.: US 7,617,570 B2
(45) Date of Patent: Nov. 17, 2009

(54) DOUBLE-PIVOT, CONSTRAINED KINEMATIC HINGE FOR A FRONT-LOADING LAUNDRY MACHINE

(75) Inventor: Eric Andrew Hill, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 458 days.

(21) Appl. No.: 11/386,404

(22) Filed: Mar. 22, 2006

(65) Prior Publication Data

US 2007/0220709 A1 Sep. 27, 2007

(51) Int. Cl.
*E05D 11/10* (2006.01)

(52) U.S. Cl. ..... 16/347; 16/370; 68/12.26

(58) Field of Classification Search ..... 16/347, 16/366, 370, 378; 34/108, 201, 139, 595, 34/603; 68/3 R, 24, 12.26, 139; 49/398, 49/400

See application file for complete search history.

(56) References Cited

U.S. PATENT DOCUMENTS

| | | | | | |
|---|---|---|---|---|---|
| 2,008,256 | A | * | 7/1935 | Lefevre | 16/370 |
| 2,051,726 | A | * | 8/1936 | Lefevre | 16/370 |
| 2,130,663 | A | * | 9/1938 | Baker | 16/370 |
| 2,149,576 | A | * | 3/1939 | Caldwell et. al. | 16/288 |
| 2,763,900 | A | * | 9/1956 | McAfee et. al. | 49/70 |
| 2,777,155 | A | * | 1/1957 | Fata | 16/357 |
| 3,611,474 | A | * | 10/1971 | Meyer | 16/358 |
| 3,883,201 | A | | 5/1975 | Busoni | |
| 3,968,540 | A | * | 7/1976 | Lautenschlager et al. | 16/370 |
| 4,095,311 | A | * | 6/1978 | Janosch | 16/370 |
| 4,389,748 | A | | 6/1983 | Grossman | |
| 4,854,010 | A | * | 8/1989 | Maraghe et al. | 16/360 |
| 5,113,562 | A | * | 5/1992 | Studt | 29/401.1 |
| 6,938,444 | B2 | | 9/2005 | Hong et al. | |
| 2003/0172692 | A1 | | 9/2003 | Hong et al. | |

FOREIGN PATENT DOCUMENTS

| | | |
|---|---|---|
| AT | 389717 | 12/1988 |
| AT | 389717 | 1/1990 |
| CH | 290826 | 5/1958 |
| DE | 4040291 | 6/1992 |

(Continued)

*Primary Examiner*—William L. Miller
(74) *Attorney, Agent, or Firm*—Clifton G. Green; Greer, Burns & Crain Ltd.

(57) ABSTRACT

A laundry machine having a front panel defining a front face with an opening therein. A pivotally attached door is arranged to selectively close the opening. The front panel has a relatively flat surface surrounding and defining the opening and has a generally annular shape. A wall projects substantially at a right angle to the flat annular surface. A hinge includes a front panel bracket secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, and a control arm pivotally attached to the front panel bracket to rotate relative thereto about a third axis and pivotally attached to the door bracket to rotate relative thereto about a fourth axis. The hinge components may extend into an interior of the door through an opening in a side of the door, leaving a rear face of the door unbroken.

18 Claims, 3 Drawing Sheets

FOREIGN PATENT DOCUMENTS

| | | |
|---|---|---|
| DE | 29802114 | 7/1998 |
| DE | 19804962 | 4/1999 |
| EP | 0293984 | 12/1988 |
| EP | 616059 | 3/1994 |
| EP | 0616069 | 3/1994 |
| EP | 0859079 | 8/1998 |
| EP | 859079 | 8/1998 |
| EP | 1046774 | 10/2000 |
| EP | 2005/042891 | 5/2001 |
| EP | 1098027 | 5/2001 |
| GB | 2360297 | 3/2000 |
| JP | 126588 | 5/2003 |
| JP | 65909 | 3/2005 |
| JP | 143794 | 6/2005 |
| WO | 03/004754 | 1/2003 |
| WO | 03/057971 | 7/2003 |
| WO | 03/057972 | 7/2003 |
| WO | 03/057973 | 7/2003 |
| WO | 2005/014913 | 2/2005 |
| WO | 2005014913 | 2/2005 |
| WO | 2005/042891 | 5/2005 |

* cited by examiner 22
23
24
26
28
30
32
34
35
36
37
38
39
40
42
44
45
46
52
58
60
62
64
66
68
74
76
78
80
20

DOUBLE-PIVOT, CONSTRAINED KINEMATIC HINGE FOR A FRONT-LOADING LAUNDRY MACHINE

BACKGROUND OF THE INVENTION

The present invention relates generally to hinges for laundry equipment such as dryers.

In many laundry machines, such as front-load washing machines, the hinges for the door require:

a. protrusion of the door forward of any parts surrounding the door, b. cutout areas in areas surrounding the door, that are attached to, and rotate with the hinge, or c. double pivot hinges, in which both pivots rotate unconstrained, and in the same direction.

The first two solutions require undesirable aesthetic choices. The third must rely on precise pivot tension, large gaps between parts, or spring mechanisms that limit, but don't always prevent binding between the door and the surrounding front panel, due to incorrect sequencing of the two pivots. It requires long hinge arms (large moment, less stability), and that one of the two pivots is placed inside the machine's housing. Cutouts through which the arm(s) pass become necessary.

An additional problem is that the inherent differences between washing machine and dryer construction prevents the use of the more common double hinge on dryers. Dryer drums are much larger than washer drums, and don't allow adequate space to pierce the machine's front panels. The typical solution is to use a single pivot hinge on the dryer only, which results in a mismatch of both kinematics and aesthetics between washer and dryer pairs.

A constrained kinematic hinge is disclosed for use on a washing machine in EP 0616069, however, this hinge is mounted to the flat front surface surrounding the opening in the front panel of the washer, precisely in the same region where a seal element is provide between the door and the opening, thus requiring the opening size to be reduced to accommodate the mounting of the hinge.

It would be an improvement in the art if a hinge and mounting arrangement for the hinge were provided for a laundry machine that would address the problems of the prior art.

SUMMARY OF THE INVENTION

The present invention provides a constrained kinematic hinge for use with a laundry machine, wherein the laundry machine has a front panel defining a front face with an opening therein closable by a pivotally attached door. The front panel also has a relatively flat surface surrounding and defining the opening with a generally annular shape. The front panel further has a wall projecting substantially at right angles to the flat annular surface. The hinge is comprised of a front panel bracket configured to be secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, and a control arm pivotally attached to the front panel bracket to rotate relative thereto about a third axis and pivotally attached to the door bracket to rotate relative thereto about a fourth axis.

By using a constrained kinematic (4-bar linkage) hinge, the advantages of the more common double-pivot hinge are realized (no need to protrude the door, or cutouts in the surrounding area), but the risk of binding is eliminated. Control linkage constrains the pivot sequence, and limits the motion of the opening door to a single, defined path. Rotating the hinge pivots in opposing directions, the entire hinge can be mounted on the exterior of the cabinet housing. This allows for simpler manufacturing, with one-sided assembly of the hinge to the machine. Unlike existing double-pivot hinges, the construction lends itself to both washers and dryers. It also eliminates cutouts that weaken the housing.

In an embodiment, the first, second, third and fourth axes are parallel to one another.

In an embodiment, none of the first, second, third and fourth axes are coaxial with one another.

In an embodiment, the front panel bracket includes a pair of spaced apart ears with coaxial journals therein for receiving a hinge pin.

In an embodiment, the door bracket includes a pair of spaced apart ears with coaxial journals therein for receiving a hinge pin.

In an embodiment, the fourth axis is defined by a hinge pin engaged with one of the ears on the door bracket.

In an embodiment, a laundry machine is provided which comprises a front panel defining a front face with an opening therein and a pivotally attached door arranged to selectively close the opening. The front panel has a relatively flat surface surrounding and defining the opening, the surface having a generally annular shape. A hinge for the door comprises a front panel bracket secured to an exterior of the front panel, a door bracket secured to the door, a primary arm pivotally attached to the front panel bracket to rotate relative thereto about a first axis and pivotally attached to the door bracket to rotate relative thereto about a second axis, the primary arm being located exclusively at the exterior of the front panel of the laundry machine in all pivotal positions of the primary arm, and a control linkage pivotally connected to the front panel bracket at a third rotational axis and to the door bracket at a fourth rotational axis to constrain a pivot sequence at the first and second axes. The front panel bracket, the door bracket, the primary arm and the control linkage, in at least some positions of the door, extending through an opening in a side of the door, and never extending through a rear face of the door.

In an embodiment, the front panel includes a wall projecting substantially at a right angle to the flat annular surface, and the front panel bracket is secured to the wall.

In an embodiment, a laundry machine is provided which comprises a front panel defining a front face with an opening therein and a pivotally attached door arranged to selectively close the opening. The front panel has a relatively flat surface surrounding and defining the opening, the surface having a generally annular shape. A wall of the front panel projects substantially at a right angle to the flat annular surface. A hinge for the door comprises a front panel bracket secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, and a control arm pivotally attached to the front panel bracket to rotate relative thereto about a third axis and pivotally attached to the door bracket to rotate relative thereto about a fourth axis.

In an embodiment, the wall has a circular cylindrical shape and the front panel bracket has an arcuate shape conforming to the wall shape.

In an embodiment, the first, second, third and fourth axes are parallel to one another.

In an embodiment, none of the first, second, third and fourth axes are coaxial with one another.

In an embodiment, the front panel bracket includes a pair of spaced apart ears with coaxial journals therein for receiving a hinge pin.

In an embodiment, the pair of spaced apart ears extend from a concave surface of the front panel bracket.

In an embodiment, the door bracket includes a pair of spaced apart ears with coaxial journals therein for receiving a hinge pin.

In an embodiment, the fourth axis is defined by a hinge pin engaged with one of the ears on the door bracket.

In an embodiment, the front panel bracket is mounted on an exterior surface of the front panel of the laundry machine.

In an embodiment, the first axis and the second axes are located on an exterior of the front panel of the laundry machine.

In an embodiment, the primary arm is located exclusively at an exterior of the front panel of the laundry machine.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figures 1, 2:
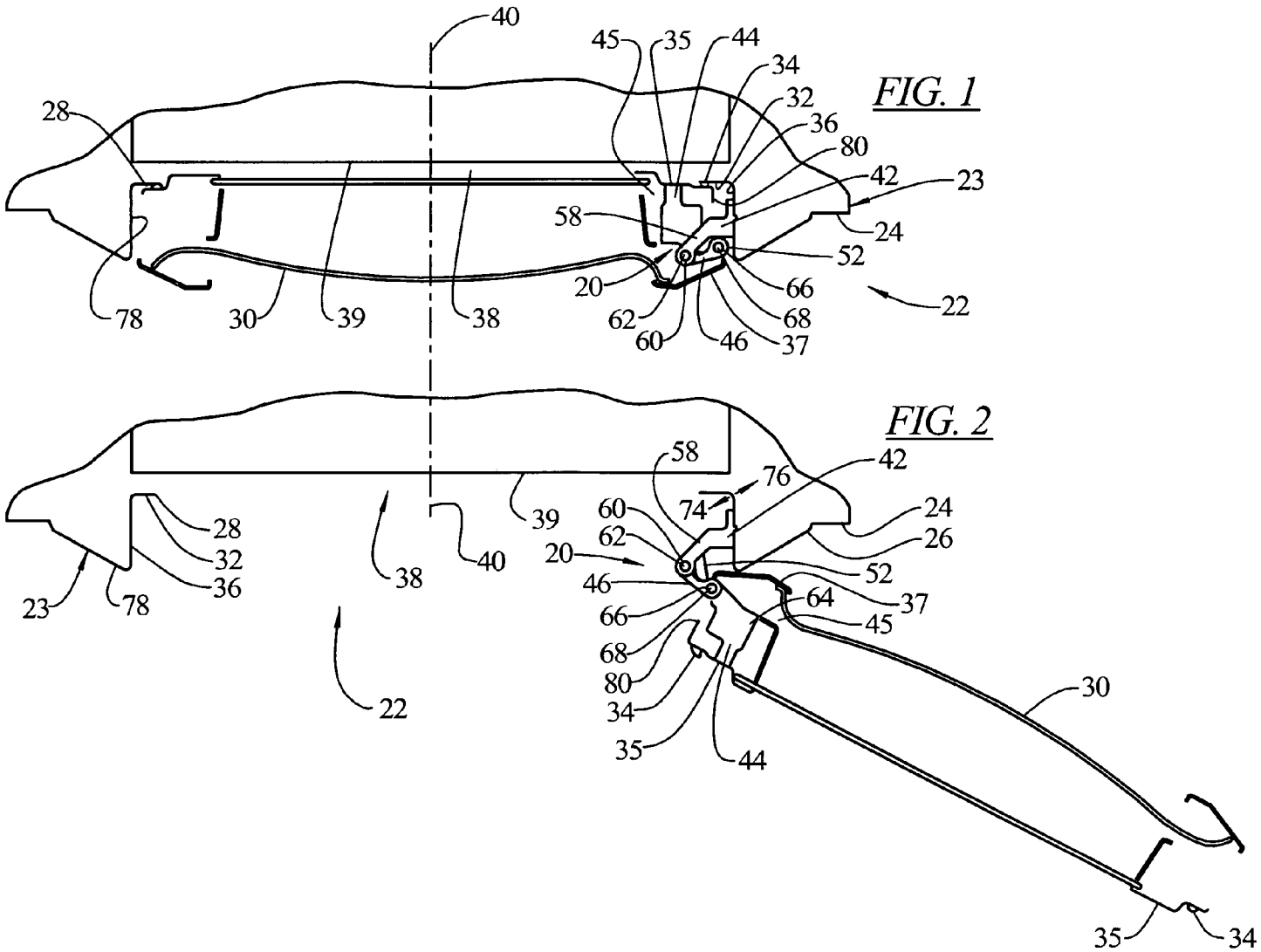
FIG. 1 is a sectional view of a door hinge area of a laundry machine with the door closed.
FIG. 2 is a sectional view of the door hinge area of FIG. 1 with the door open.

The present invention provides a hinge 20 for use with a laundry machine 22, such as a dryer, wherein the laundry machine has a cabinet 23 with a front panel 24 defining a front face 26 with an opening 28 therein closable by a pivotally attached door 30. Particular embodiments of the invention are illustrated, however the scope of the invention is not limited to the particular embodiments illustrated.

The front panel 24 also has a relatively flat surface 32 parallel to the front face 26 surrounding and defining the opening 28. This flat surface 32 has a generally annular shape and is used as a seat for receiving a seal 34 between the front panel 24 and the door 30. Although the seal 34 is shown as being mounted on a rear face 35 of the door 30 to press against the flat surface 32, the seal could also be mounted on the flat surface 32 to press against the rear face 35 of the door 30. The front panel 24 further has a wall 36 connected to and projecting substantially at a right angle to the flat annular surface 32, extending at an angle from the front face 26, to which it is also connected. The wall 36 spaces the flat surface 32 from the front face 26, providing a recess for the door 30 such that a front face 37 of the door 30 is flush with a contour of the front face 26 of the front panel 24.

In an embodiment, the wall 36 is at least partially cylinder shaped to surround the opening 28, spaced a distance from the opening by the surface 32. Since the door 30 of the laundry machine 22 is used to enclose a chamber 38 where clothing and fabric articles are treated, such as by heated air in a dryer, or by a wash liquor in a washer, the seal 34 is provided between the door 30 and the flat surface 32 of the front panel 24 to maintain the treating environment within the chamber 38. The seal 34 extends around the entire perimeter of the door 30 to provide a complete seal at the opening 28. In some embodiments of the invention, the chamber 38 includes a drum or basket 39 which rotates about an axis 40 extending perpendicular to the flat surface 32 and parallel to the wall 36.

The hinge 20 is comprised of a front panel bracket 42 configured to be secured to the wall 36 of the front panel 24, a door bracket 44 secured within a pocket 45 in the door 30 of the laundry machine 22, a primary arm 46 pivotally attached to the front panel bracket 42 to rotate relative thereto about a first axis 48 and pivotally attached to the door bracket 44 to rotate relative thereto about a second axis 50, and a control arm 52 pivotally attached to the front panel bracket 42 to rotate relative thereto about a third axis 54 and pivotally attached to the door bracket 44 to rotate relative thereto about a fourth axis 56. The control arm 52 acts as a control linkage to constrain a pivot sequence at the first 48 and second 50 axes.

In the embodiment illustrated in the FIGs., the first 48, second 50, third 54 and fourth 56 axes are parallel to one another, but none of the first, second, third and fourth axes are coaxial with one another.

The front panel bracket 42 includes a pair of spaced apart ears 58 with coaxial journals or passages 60 therein for receiving a hinge pin 62. The door bracket 44 includes a pair of spaced apart ears 64 with coaxial journals or passages 66 therein for receiving a hinge pin 68. The fourth axis 56 is defined by a hinge pin 70 engaged with one of the ears 64 on the door bracket 44.

Figure 3:
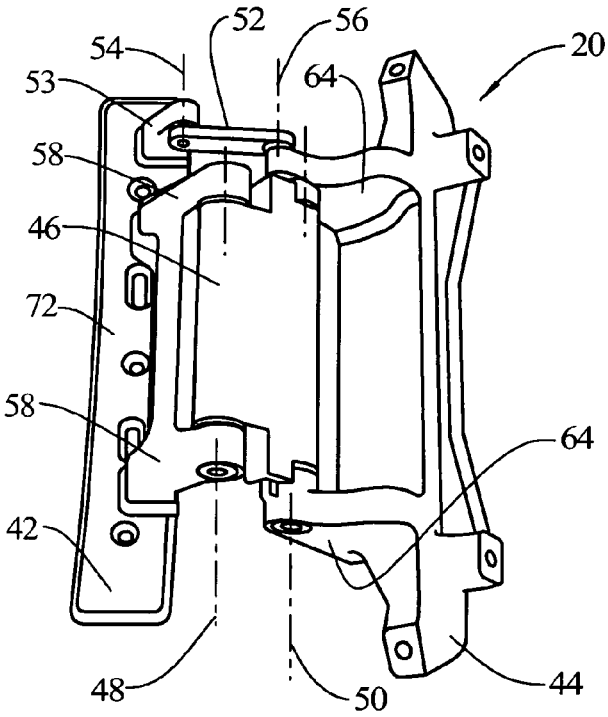
FIG. 3 is a perspective view of the door hinge in isolation in the open position.
Figure 5:
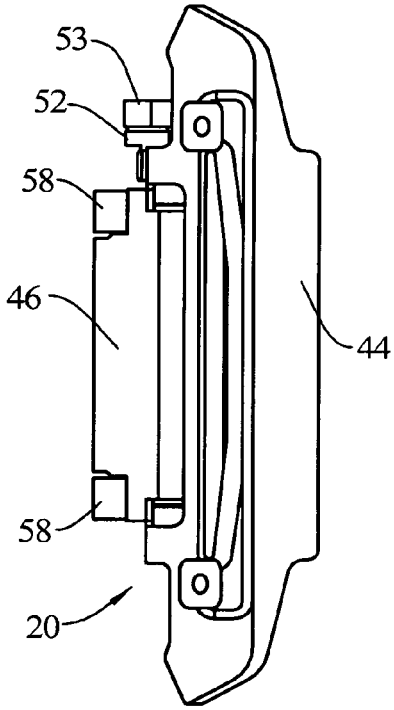
FIG. 5 is a side elevational view of the door hinge in an open position, and viewed from the right side of FIG. 4.
Figure 4:
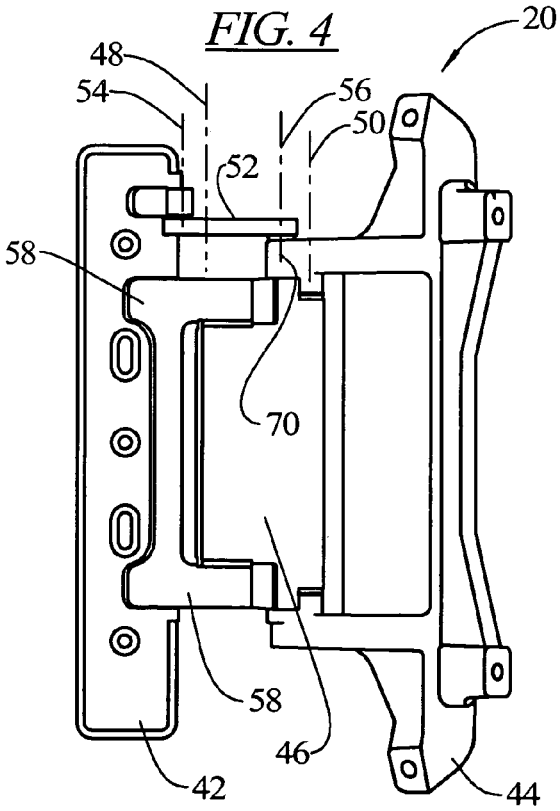
FIG. 4 is a side elevational view of the door hinge in an open position.
Figure 6:
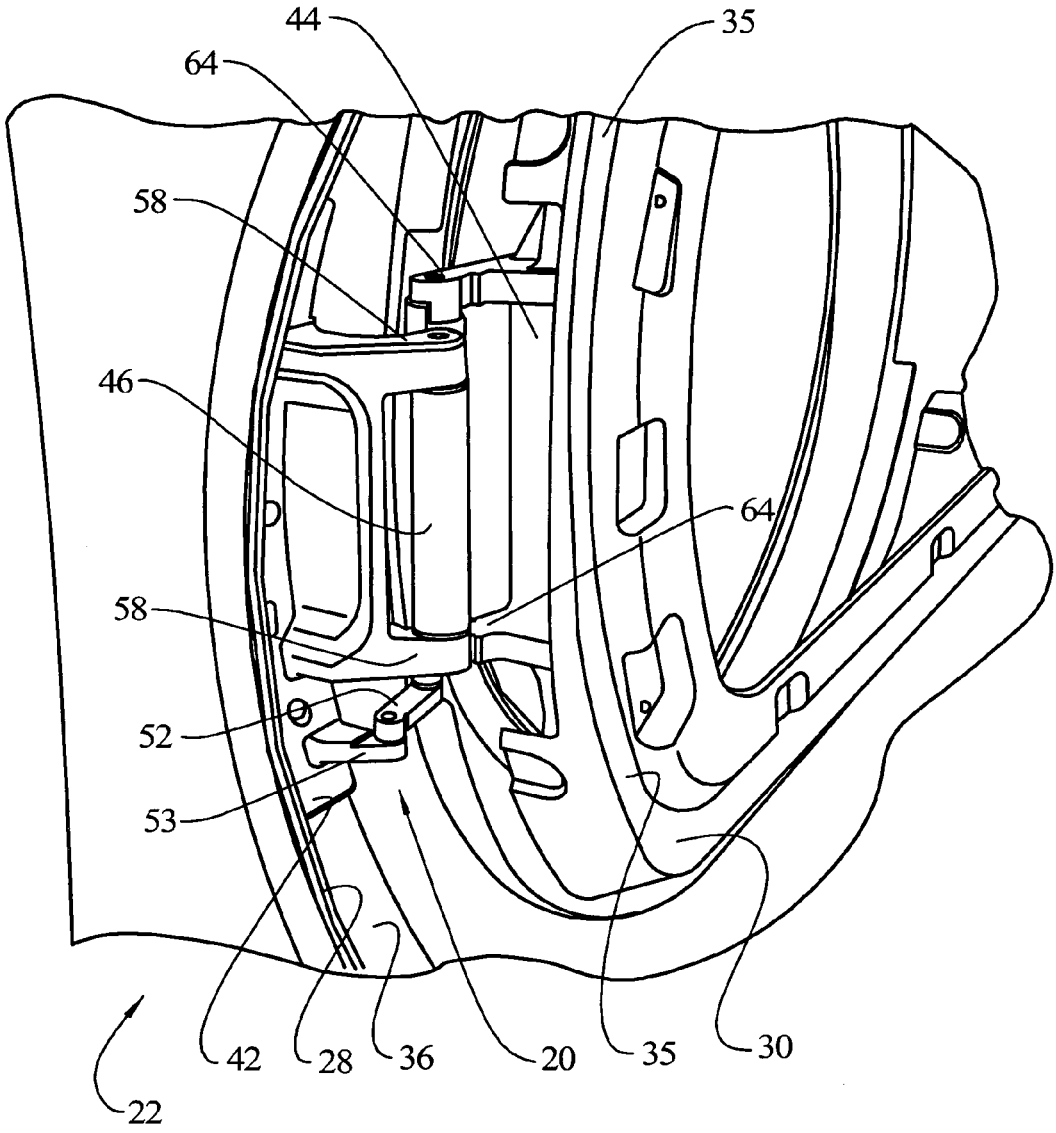
FIG. 6 is a perspective view of the door hinge, door and laundry machine cabinet viewed from an interior of the cabinet with the door partially open.

In the embodiment where the wall 36 has at least a partially cylindrical shape, the front panel bracket 42 is provided with an arcuate shape conforming to the wall shape. As shown in FIGS. 3 and 6, the pair of spaced apart ears 58 extend from a concave surface 72 of the front panel bracket 42. By having the hinge 20 mount to the wall 36, rather than the flat surface 32, a size of the opening 28 can be maximized since none of the space of the flat surface 32 is required for engagement by the seal 34. A larger opening size is desired to allow the user easier access to the treatment chamber 38.

In the mounting of the hinge 20 to the laundry machine, the primary arm 46 is located exclusively at an exterior 74 of the front panel 24 of the laundry machine 22 in all pivotal positions of the primary arm. In such an arrangement, the front panel 24 need not be cut into to allow for the primary arm 46 to move into and out of an interior 76 of the front panel, as is required in some prior art hinge mounting constructions. This arrangement occurs since the front panel bracket 42 is mounted on an exterior surface 78 of the front panel 24 of the laundry machine 22. What this also means is that the first axis 48 and the second axis 50 are located on the exterior 74 of the front panel 24 of the laundry machine 22.

Also, the hinge components, namely, the front panel bracket 42, the door bracket 44, the primary arm 46 and the control arm 52 extend into and out of a side opening 80 in the door 30 leading to the pocket 45, and not through the rear face 35 of the door. This means that the rear face 35 of the door 30 will remain unbroken and that the seal 34 can remain at the extreme periphery of the rear face of the door, also unbroken. Thus, the front panel opening 28 size can be maximized relative to a size of the door, as contrasted to a construction where the hinge components extend or unfold through the rear face of the door.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A hinge for use with a laundry machine having a front panel defining a front face with an opening therein closable by a pivotally attached door, the front panel having a relatively flat surface surrounding and defining the opening and having a generally annular shape, and a wall projecting substantially at right angles to the flat annular surface, the hinge comprising:

a front panel bracket configured to be secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, a control arm pivotally attached to the front panel bracket to rotate relative thereto about a third axis and pivotally attached to the door bracket to rotate relative thereto about a fourth axis, wherein none of the first, second, third and fourth axes are coaxial with one another.

2. A hinge according to claim 1, wherein the first, second, third and fourth axes are parallel to one another.

3. A hinge according to claim 1, wherein the front panel bracket includes a pair of spaced apart ears with coaxial journals therein for receiving a hinge pin.

4. A hinge for use with a laundry machine having a front panel defining a front face with an opening therein closable by a pivotally attached door, the front panel having a relatively flat surface surrounding and defining the opening and having a generally annular shape, and a wall projecting substantially at right angles to the flat annular surface, the hinge comprising:

a front panel bracket configured to be secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, a control arm pivotally attached to the front panel bracket to rotate relative thereto about a third axis and pivotally attached to the door bracket to rotate relative thereto about a fourth axis, wherein the door bracket includes a pair of spaced apart ears with coaxial journals therein for receiving a hinge pin.

5. A hinge according to claim 4, wherein the fourth axis is defined by an additional hinge pin engaged with one of the ears on the door bracket.

6. A laundry machine comprising:

a front panel defining a front face with an opening therein, a pivotally attached door arranged to selectively close the opening, the front panel having a relatively flat surface surrounding and defining the opening and having a generally annular shape, a hinge comprising:

a front panel bracket secured to an exterior of the front panel and, at least in some positions of the door, extending into an interior of the door through an opening in a side of the door, and never extending through a rear face of the door, a door bracket secured to the interior of the door and extending out of the opening in the side of the door, and never extending through the rear face of the door, a primary arm pivotally attached to the front panel bracket to rotate relative thereto about a first axis and pivotally attached to the door bracket to rotate relative, thereto about a second axis, the primary arm being located exclusively at an exterior of the front panel of the laundry machine in all pivotal positions of the primary arm, and at least in some positions of the door, extending through the opening in the side of the door, and never extending through the rear face of the door, a control linkage pivotally connected to the front panel bracket at a third rotational axis and to the door bracket at a fourth rotational axis to constrain a pivot sequence at the first and second axes, the control linkage, in at least some positions of the door, extending through the opening in the side of the door, and never extending though the rear face of the door.

7. A laundry machine according to claim 6, wherein the front panel further includes a wall projecting substantially at a right angle to the flat annular surface, and the front panel bracket is secured to the wall.

8. A laundry machine comprising:

a front panel defining a front face with an opening therein, a pivotally attached door arranged to selectively close the opening, the front panel having a relatively flat surface surrounding and defining the opening and having a generally annular shape, a wall projecting substantially at a right angle to the flat annular surface, a hinge comprising:

a front panel bracket secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, a control arm pivotally attached to the front panel bracket to rotate relative thereto about a third axis and pivotally attached to the door bracket to rotate relative thereto about a fourth axis, wherein none of the first, second, third and fourth axes are coaxial with one another.

9. A laundry machine according to claim 8, wherein the wall has a circular cylindrical shape and the front panel bracket has an arcuate shape conforming to the wall shape.

10. A laundry machine according to claim 8, wherein the first, second, third and fourth axes are parallel to one another.

11. A laundry machine according to claim 8, wherein the front panel bracket includes a pair of spaced apart ears with coaxial journals therein for receiving a hinge pin.

12. A laundry machine according to claim 11 wherein the pair of spaced apart ears extend from a concave surface of the front panel bracket.

13. A laundry machine according to claim 8, wherein the front panel bracket is mounted on an exterior surface of the front panel of the laundry machine.

14. A laundry machine according to claim 8, wherein the first axis and the second axes are located on an exterior of the front panel of the laundry machine.

15. A laundry machine according to claim 8, wherein the primary arm is located exclusively at an exterior of the front panel of the laundry machine.

16. A laundry machine comprising:

a front panel defining a front face with an opening therein, a pivotally attached door arranged to selectively close the opening, the front panel having a relatively flat surface surrounding and defining the opening and having a generally annular shape, a wall projecting substantially at a right angle to the flat annular surface, a hinge comprising:

a front panel bracket secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, a control arm pivotally attached to the front panel bracket to rotate relative thereto about a third axis and pivotally attached to the door bracket to rotate relative thereto about a fourth axis, wherein the door bracket includes a pair of spaced apart ears with coaxial journals therein for receiving a hinge pin.

17. A laundry machine according to claim 16, wherein the fourth axis is defined by an additional hinge pin engaged with one of the ears on the door bracket.

18. A laundry machine comprising:

a front panel defining a front face with an opening therein, a pivotally attached door arranged to selectively close the opening, the front panel having a relatively flat surface surrounding and defining the opening and having a generally annular shape, a wall projecting substantially at a right angle to the flat annular surface, a hinge comprising:

a front panel bracket secured to the wall of the front panel, a door bracket secured to the door of the laundry machine, a primary arm pivotally attached to the front panel bracket to rotate relative thereto about a first axis and pivotally attached to the door bracket to rotate relative thereto about a second axis, a control arm pivotally attached to the front panel bracket to rotate relative thereto about a third axis and pivotally attached to the door bracket to rotate relative thereto about a fourth axis, wherein the front panel bracket, the door bracket, the primary arm and the control arm, at least in some positions of the door, extend through an opening in a side of the door, and never extend through a rear face of the door.

* * * * *

UNITED STATES PATENT AND TRADEMARK OFFICE

CERTIFICATE OF CORRECTION

PATENT NO. : 7,617,570 B2
APPLICATION NO. : 11/386404
DATED : November 17, 2009
INVENTOR(S) : Eric Andrew Hill It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 698 days.

Signed and Sealed this

Nineteenth Day of October, 2010

David J. Kappos

David J. Kappos
*Director of the United States Patent and Trademark Office*